US006401569B2

(12) United States Patent
Usbeck

(10) Patent No.: US 6,401,569 B2
(45) Date of Patent: Jun. 11, 2002

(54) CORKSCREW

(76) Inventor: Friedrich W. Usbeck, Kleistweg 2, D-35039 Marburg (DE)

( * ) Notice: Subject to any disclaimer, the term of this patent is extended or adjusted under 35 U.S.C. 154(b) by 0 days.

(21) Appl. No.: 09/021,022

(22) Filed: Feb. 9, 1998

Related U.S. Application Data

(60) Provisional application No. 60/037,889, filed on Feb. 10, 1997.

(51) Int. Cl.[7] ..... B67B 7/04

(52) U.S. Cl. ..... 81/3.36; 81/3.29

(58) Field of Search ..... 81/3.36, 3.37, 81/3.29, 3.39, 3.45, 3.48

(56) References Cited

U.S. PATENT DOCUMENTS

| | | | | | |
|---|---|---|---|---|---|
| 310,766 | A | * | 1/1885 | Wilhelm | 81/3.29 |
| 518,018 | A | * | 4/1894 | Becker | 81/3.29 |
| 4,377,096 | A | * | 3/1983 | Allen | 81/3.36 |

* cited by examiner

*Primary Examiner*—D. S. Meislin

(74) *Attorney, Agent, or Firm*—Israel Gopstein

(57) ABSTRACT

A corkscrew (10) has a handle (12) mounted to a screw stem (14) rotatably guided within a cap (18) which contains upper ends of two prongs (40). The prongs have semi-circular lower ends (48) which surround a screw (16) and comprise inner shoulder stops (64) for engaging on a bottle-neck. Upper ends (42) of the prongs are articulated to a core unit (20) having a guide bush (22) for the screw stem (14). Cap (18) may be integral with the handle (12). Alternatively, the handle may be screw-fitted to a tapped stem (84) guided by the cap. Bearing means for the upper prong ends, on which expanding springs (65) bear, find stops at a lower peripheral edge of cap (18). A lug (50) supports each upper prong end (42) on a pin (34) that traverses a guiding cheek (30) on the guide bush (22). Radial bell ribs (44) have lower leading edges (45) in each central portion (46) of the prongs (40). Various screw types may be exchangeably used, and a preferred type is a bladed type (16; 16') having wide sharp flares or a round wire hollow helix (16"), either ending in a pointed tip (78). A sleeve (80) may first be put over a captive screw (16') whereupon the screw top can be mounted to handle (12). A widened lower screw end cannot pass beyond sleeve (80) and is thus movably retained therein. The screw made of steel may be surface-treated by plating, enameling, teflon-coating or the like for minimum friction.

23 Claims, 5 Drawing Sheets

CORKSCREW

This application claims benefit to U.S. provisional Serial No. 60/037,889, filed Feb. 10, 1997.

TECHNICAL FIELD

This invention relates to a corkscrew, and more particularly to a corkscrew having a handle mounted to a screw stem which is rotatably guided within a cap.

BACKGROUND ART

Corkscrews have been known for centuries. A particular type as disclosed in U.S. Pat. No. 310,766 (B. Wilhelm) includes a handle mounted to a cone-shaped part, the bottom of which has a circular groove for receiving two semi-circular tongues. These tongues surround a screw and form the upper ends of loose prongs having inner shoulders that are capped by a slidable ring. A screw stem comprising a bearing disk is fixed to the handle so as to axially hold the components together. In operation, the screw tip is turned into a cork and the ring is slid up or down, respectively, so that the lower prong ends will first be spread and then moved together as lower prong shoulders are placed onto the neck of a bottle. Further turning of the handle will force the cork up between the prongs while the device is pressed onto the bottle.

More modern corkscrews of similar type include a housing or bell that is solid with two prongs. These modern corkscrews have inner semi-circular stops to be placed onto a bottle neck. Under a firm grip to hold the bottle and housing together, a loose screw or worm can be put through a housing top portion that serves for guiding the screw which, upon turning, will enter the cork. As the latter raises between lateral ribs of the housing, it will thereby be held against rotation; once it is lifted out of the bottle, simple counter-turning of the screw handle will eject the cork from the bell.

Other corkscrews named after Reissmann have a tapped stem screw borne within a matching tapped bush of a bell or housing. A tiltable top nut through which a handle rod extends transversely also screws with the stem thread. With the housing bottom put onto a bottle neck, the handle is turned one way from a first upper position so as to penetrate the cork, and under continued turning the handle will screw down on the stem and the cork is extracted from the bottle; then the nut is tilted, the handle is turned upwards the other way and turning is continued until the cork drops out from between retaining bell ribs.

While each of the foregoing designs has its merits, there are specific drawback thereto. Thus, the corkscrew initially described requires precise manufacture and mounting, and the assembly of the various components is critical in that both close fit and rotatability are of the essence for trouble-free use. In addition, there are no centering means for the screw which is thus quite likely to sometimes obliquely enter a cork. Solid bells cannot fit bottle necks of widely differing sizes. Conventional Reissmann corkscrews, in particular, have a short housing pot that will not readily warrant centered application to a corked bottle so that it may again be possible to penetrate the cork in a slanted direction, resulting in its split-up.

DISCLOSURE OF THE INVENTION

The present invention aims at overcoming these and other drawbacks of the prior art.

It is an object of the invention to create a corkscrew that combines advantages of earlier designs in a simple and economical manner.

A particular object of the invention is the creation of a two-prong corkscrew of sturdy design that permits fairly cheap manufacture and ease of use; especially with well centered application onto bottle necks of various sizes.

It is another object of the invention to provide a corkscrew having a screw which is surface-treated for minimum friction and is designed fore easy piercing into a cork and for providing a large engagement area therein.

Various features of the invention are recited in the appended claims.

Thus, in accordance with one aspect of the invention, there is provided an improvement in a corkscrew including a handle mounted to a screw stem rotatably guided within a cap which contains upper ends of two prongs having semi-circular lower ends that surround a screw and comprise inner shoulder stops adapted for engagement on a bottle neck. The improvement is particularly characterized in that the upper prong ends are articulated to a core unit to which a guide bush for the screw stem is associated, and in that the prong ends are spring-biased to provide a spreading force towards the perimeter of the cap.

The above noted feature is of significance in permitting very easy application of the corkscrew to bottle necks of widely varying diameters which are gripped by the prongs for centered engagement of the screw to a cork to be extracted therefrom. The cap may be integral with the handle, or the latter may be screw-fitted to a tapped stem which is guided by the cap.

The core unit may include bearing means for the upper prong ends on which expanding springs bear and which have and/or find stops in the region of a lower peripheral edge of the cap.

More particularly, each of the upper prong ends may comprise a lug for support on a pin which traverses guiding cheeks of the core unit on either outward side of the guide bush.

Cork retaining and removing means in a bell may include radial ribs having lower leading edges in each central portion of the prongs. Various types of screws or worms can be exchangeably used. Preferably, a bladed type is used, having wide sharp flares or a round wire hollow helix, either one ending in a pointed tip. Still more particularly, the screw is preferably made of steel and is surface-treated for minimum friction, e.g., by plating, enameling or teflon-coating.

The screw may conically widen downwards, and thus be captive in respect of the core unit in which it is guided.

These and other objects, features and advantages of the present invention will become readily apparent to those skilled in the art from the following description and drawings, wherein there is shown and described a preferred embodiment of the invention, simply by way of illustration and not of limitation of one of the best modes (and alternative embodiments) suited to carry out the invention.

The invention itself is set forth in the claims appended hereto. As will be realized upon examination of the specification and drawings and from practice of the same, the present invention is capable of still other, different, embodiments and its several details are capable of modifications in various obvious aspects, all without departing from the scope of the invention as recited in the claims. Accordingly, the drawings and the descriptions provided herein are to be regarded as illustrative in nature and not as restrictive of the invention.

BRIEF DESCRIPTION OF THE DRAWING

The accompanying drawings, incorporated into and forming a part of the specification, illustrate several aspects of a preferred embodiment of the present invention and, together with the description, serve to explain the principles of the invention. In the drawings.

BEST MODE FOR CARRYING OUT THE INVENTION

Figure 1:
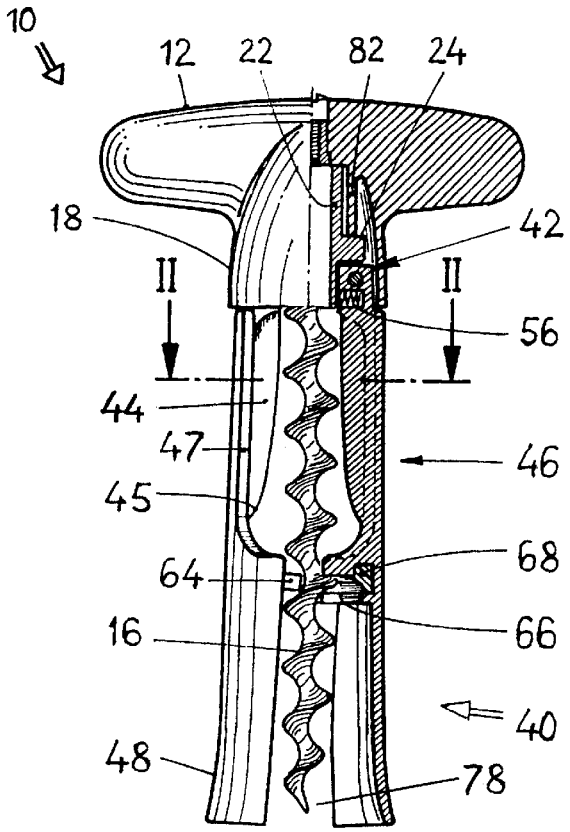
FIG. 1 is a side view, partly in longitudinal section, of a novel corkscrew in accordance with the invention.
Figure 2:
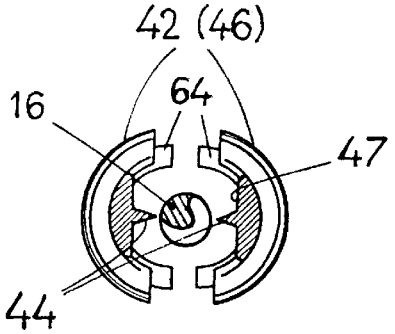
FIG. 2 is a cross section along line II—II of FIG. 1.

Referring now to the drawings, FIGS. 1–6 show preferred embodiments of a corkscrew 10 according to the invention. The embodiment illustrated in FIGS. 1 and 2 includes a handle 12 to which a screw stem 14, having a worm or screw 16, is exchangeably fixed. A cap 18 is integral with the handle 12 and tops a core unit 20, as well as a guide bush 22 having a bore 23 (shown in FIGS. 5 and 6) in which the screw stem 14 and the screw 16 proper are respectively guided. It is noted that handle 12 and screw 16 form one component that may be inserted in core unit 20 or may be withdrawn therefrom.

Two prongs 40, preferably of metal, have upper ends 42 which are articulated to a socket 26 of core unit 20. The upper ends of the prongs are biased by springs 56 in a direction to enable lower ends 48 of the prongs 40 to fit easily over bottle necks of various sizes (not shown). As also provided in the embodiment shown in FIG. 5, a flange 24 of core unit 20 separates the guide bush 22 from the upper ends 42 and may serve as a stop to the upper ends, just as a shoulder 28 of socket 26 (shown in FIGS. 5 and 6). The latter includes two pairs of parallel cheeks 30 defining radial chambers 36 and having transverse bores 32 therein in order to receive pins 34, which also pass through transverse bores 52 in lugs 50 of the upper prong ends 42. Lugs 50 contain blind holes 54 therein, for seating outer ends 58 of compression springs 56 which bear on an outer portion 62 of each of the upper ends 42 for limited spreading of the prongs 40.

Figure 3:
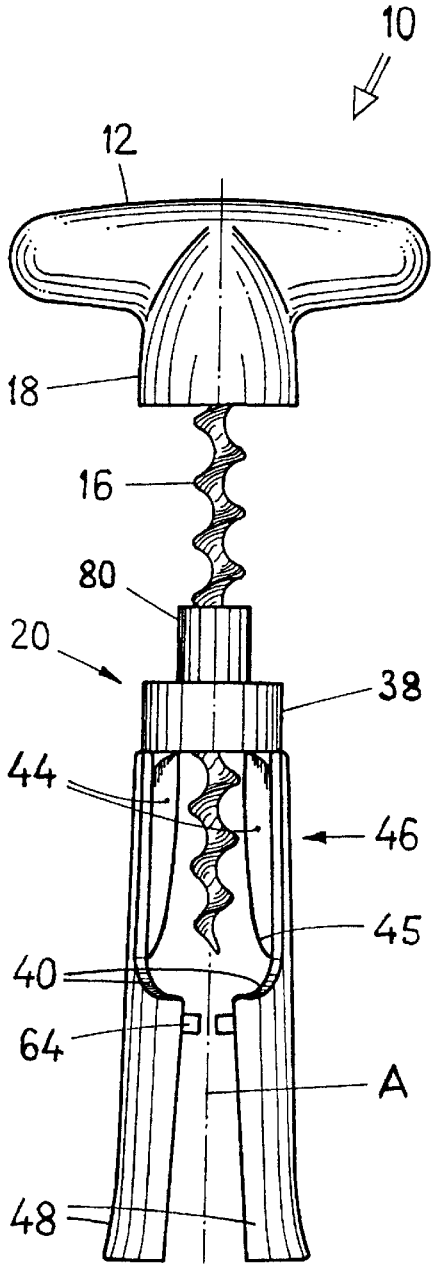
FIG. 3 is a side view similar to FIG. 1 but with partly elevated handle and screw.
Figure 4:
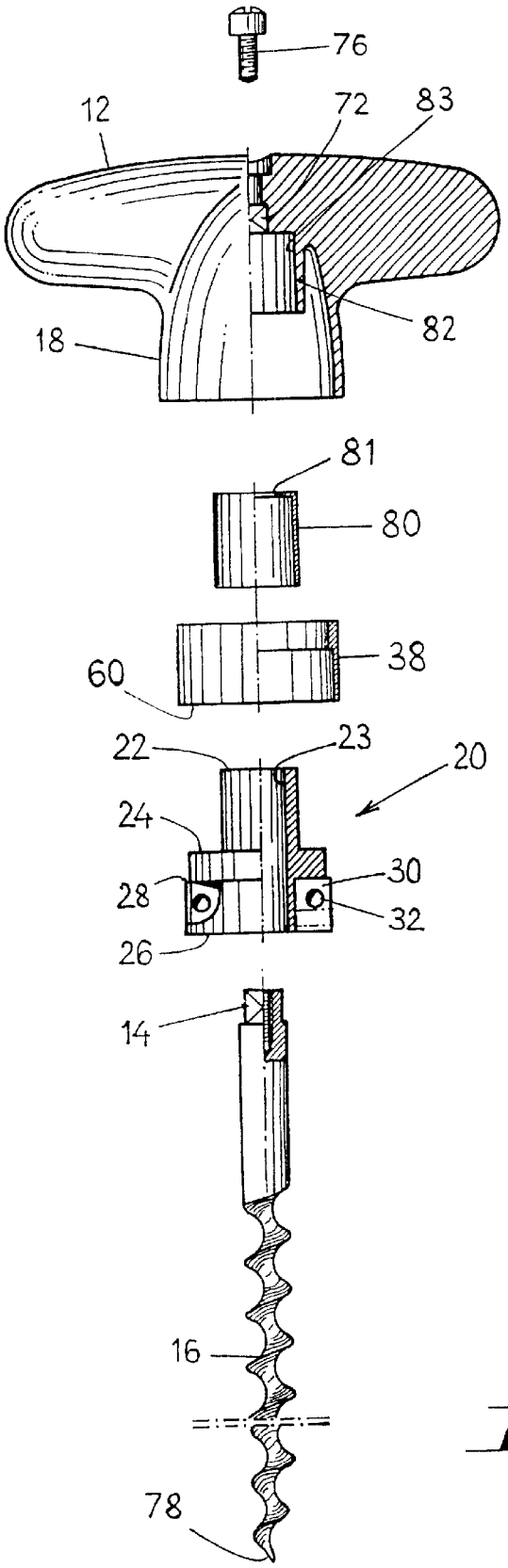
FIGS. 4 to 6 are exploded side views of various corkscrew components, FIG. 4 showing three alternatives of screws.
Figure 4A:
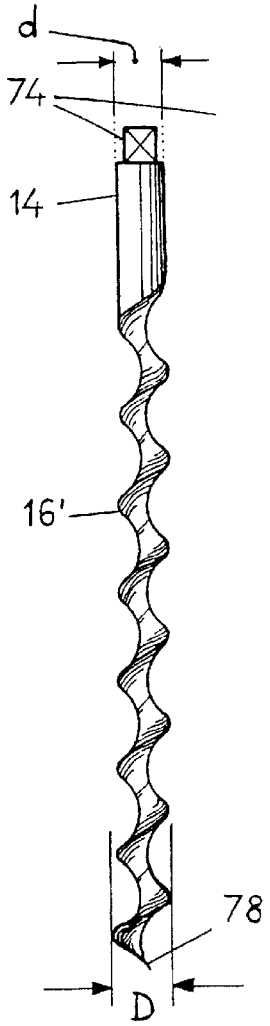
Figure 4B:
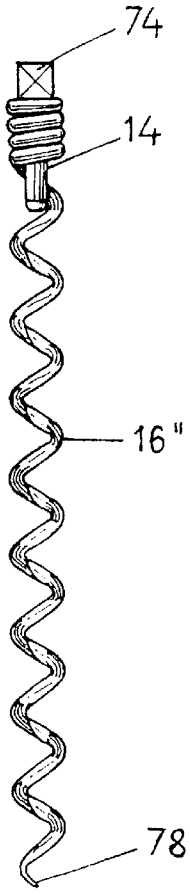
Figure 5:
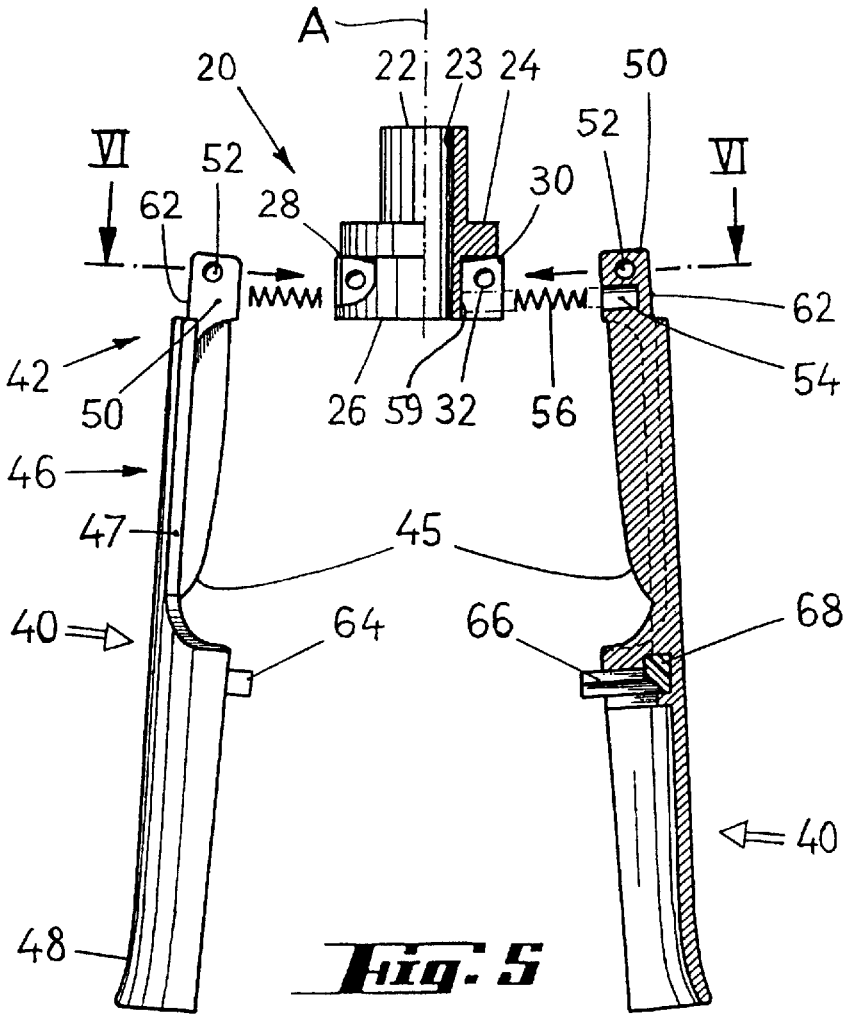
Figure 6:
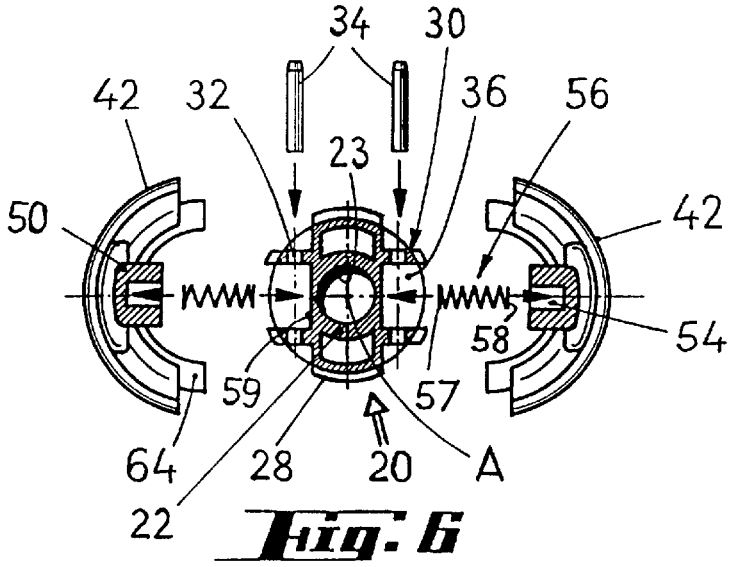
Figure 7:
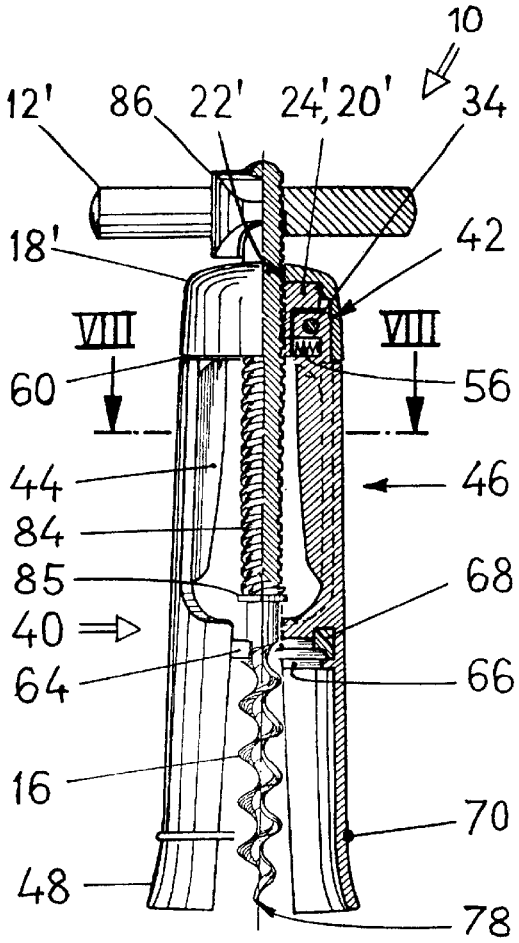
FIG. 7 is a side view of a different embodiment, similar to the view shown in FIG. 1.
Figure 8:
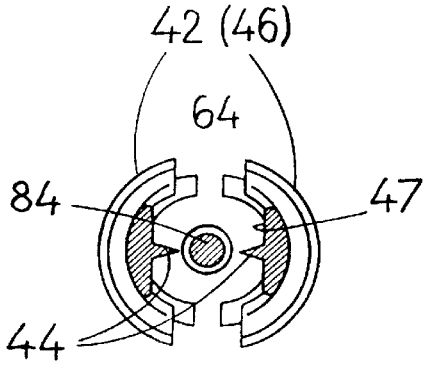
FIG. 8 is a cross section along line VIII—VIII of FIG. 7.
Figure 9:
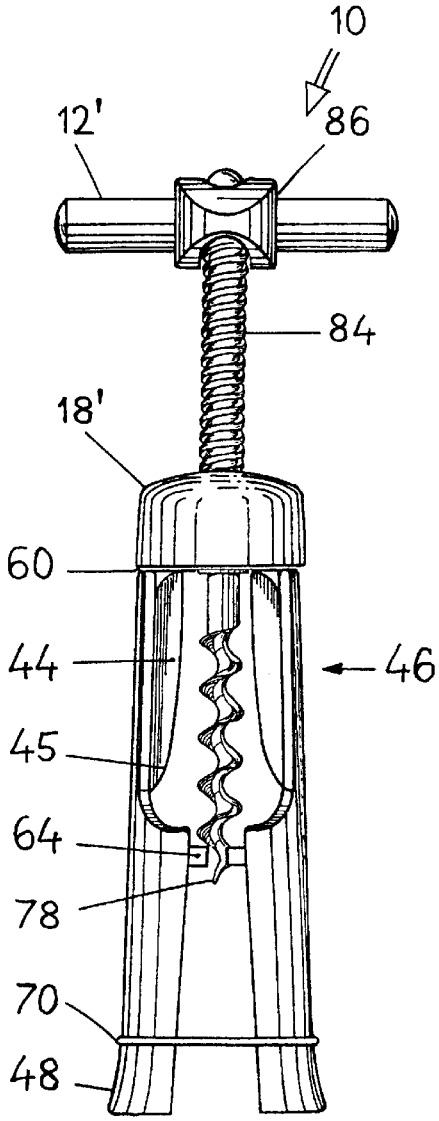
FIG. 9 is a side view of the embodiment shown in FIG. 8, similar to the view shown in FIG. 3.

Inner ends 57 of the springs 56 are each contained in the chamber 36 and bear on a wall 59 therein (as shown in FIGS. 5 and 6). A sliding ring 38 (FIGS. 3 and 4) may snugly encompass the socket 26 as well as the outer portions 62 inside cap 18 for reducing friction during the cork extraction operation (as shown in FIG. 3). Similarly, a sleeve 80 may snugly fit the guide bush 22 inside a handle collet 82 (FIG. 1). In this embodiment of the invention, sliding ring (38) includes a lower peripheral edge which serves as a stop to the outer portion of each of the upper prong ends.

Prongs 40 have a central portion 46, comprising opposite ribs 44 that extend radially from inner prong walls 47. Each rib 44 has a lower leading edge 45 that may be curved or slanted relative to the corkscrew axis A, and which serves to receive a rising cork which is then retained between the ribs 44 until, after extraction, the cork is pushed off as handle 12 is counter-turned. The expelled cork will automatically fall out of the corkscrew 10 from between its slightly spreaded prongs 40. Below the central portion 46 that forms a bell-type housing, shoulder stops 64 preferably made of plastics are seated in an inner groove 66 and are anchored by a detent 68. Stops 64 serve for rather gentle engagement on the bottle-neck. The lower ends 48 of prongs 40 are curved outwardly to facilitate gripping a bottle-neck.

A preferred worm or screw 16 includes a stem 14 having an upper square 74 which fits into a square hole 72 of handle 12, and which can fixed thereto by means of a bolt 76 (FIG. 4) or other fastener. The pitched screw 16 is preferably of the bladed type and comprises wide coil flares that are bevelled or cyphered to provide a continuous sharp helical edge ending in a pointed tip 78. The flare area or effective cross section is large and thus provides ample engagement in a cork so that, even if in a deteriorated state, the cork is very likely to be lifted out of the bottle.

Alternatively, a steep-pitched center worm or screw 16' may be employed (left hand portion of FIG. 4). Yet another worm or screw 16", of the hollow helical type (right hand portion of FIG. 4) may also be inserted in handle 12, and likewise may be fixed via a square connection of the type illustrated at 74/72.

Figure 10:
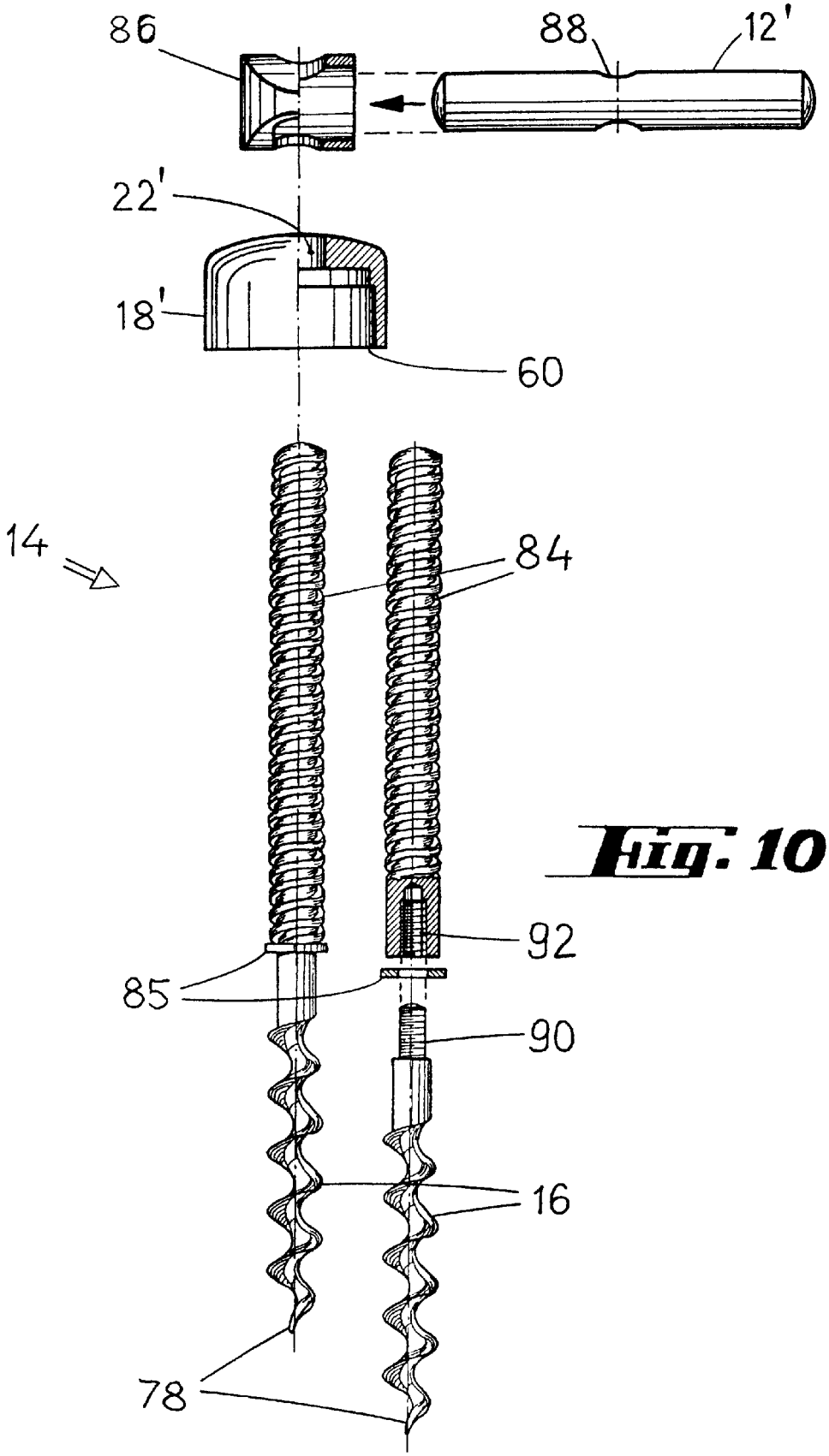
FIG. 10 is an exploded side view of several corkscrew components.

In a two-part design shown in FIG. 10, the worm or screw 16 proper may include a threaded bolt portion 90 that engages with a threaded hole 92 in the stem 14 or stem extension 84.

Handle 12 and screw 16 may be captive in respect of core unit 20. The example at the left hand portion of FIG. 4 shows that the lower end of screw 16' may widen slightly towards its tip 78, e.g. conically, so that the lower screw end has a somewhat larger diameter D adjacent tip 78 than at any other screw portion. Moreover, a bore 81 of inner diameter d in sleeve 80, which is put over the top of screw 16', matches the outer diameter of the latter in particular at its top and central portions, and is likewise slightly smaller than the outer diameter D of the lower screw end.

By first putting sleeve 80 over screw 16', the screw top can be mounted to handle 12. As the lower screw end of the embodiment at the left hand portion of FIG. 4 is widened, it cannot pass beyond sleeve 80 and is thus movably retained therein.

It should be understood that handle 12, which is bolted to the screw top of smaller diameter d, is thus captively but movably held to the core unit 20. Sleeve 80 also serves as a bearing inside handle collet 22 (FIG. 4). After extraction of a cork, if the screw 16' is counter-turned for unscrewing from the cork, whereby the screw 16' usually rises relative to socket 26, the wider lower screw end will clampingly engage the smaller bore 81 so that sleeve 80 will also counter-turn in a bearing bush 83 inside the collet 22 in whose central bore 23 the screw body is guided. This clamping connection between the sleeve 80 and the lower screw end will be released immediately as handle 12, and thus screw 16', is turned again in the screwing direction.

The worm or screw 16 (or 16' or 16") is preferably made of steel, and is surface-treated for minimum friction, in particular by a plating process on the basis of copper, nickel, chrome, tin or alloys thereof. Velvet finish nickel-plating may also be used, as well as any other appropriate process for reduction of friction. As previously noted herein, such friction reduction treatment may also include enameling or teflon-coating.

A further embodiment of a corkscrew according to the invention is shown in FIGS. 7 to 10. This embodiment is of the above noted Reissmann type, and includes a handle 12', adapted to be inserted in a tiltable nut 86 and provided with a tapped bore 88. Nut 86 and bore 88 match the thread of a tapped extension 84 of a stem 14 and screw 16, respectively. In the present embodiment, the latter comprises a bolt portion 90 designed to be screwed into a threaded hole 92 of tapped stem extension 84, with an interposed stop ring 85.

In the embodiment of FIGS. 7–10, guide bush 22' is integral with cap 18', rather than with core unit 20', which is shown as including a flange 24'. Flange 24' may be associated with a socket 26' (not shown). Cap 18' also includes a lower stop edge 60. Guide bush 22' of this embodiment guides the tapped stem extension 84, the top of which forms a captive screw so that previously mounted nut 86 cannot spin off.

A snap ring 70 may be seated, especially in a peripheral flute (indicated in FIG. 7), at the lower ends 48 of prongs 40. Snap ring 70 equals or exceeds the spreading force of springs 56 and serves to hold the prongs 40 resiliently together, especially to assist centered application on a bottleneck, but also to facilitate the grip thereon and/or to retain the device when the corkscrew 10 is stationed on a table or on an extra wooden post (not shown) prior to use.

The foregoing description of the preferred embodiments of the invention has been presented for purposes of illustration and description. It is not intended to be exhaustive or to limit the invention to the precise forms disclosed, since many modifications or variations thereof are possible in light of the above teaching. All such modifications and variations are within the scope of the invention. The embodiments described herein were chosen and described in order best to explain the principles of the invention and its practical application, thereby to enable others skilled in the art to utilize the invention in various embodiments and with various modifications as are suited to the particular use contemplated therefor. It is intended that the scope of the invention be defined by the claims appended hereto, when interpreted in accordance with the full breadth to which they are legally and equitably entitled.

What is claimed is:

1. In a corkscrew (10) including a handle (12), the handle having a portion forming a cap (18) and being mounted to an upper stem portion (14) of a screw (16), the stem portion (14) extending within the cap (18), the cap configured to contain, in an operable position, upper prong ends (42) of two prongs (40), the prongs (40) having semi-circular lower ends (48), said lower ends (48) having shoulder stops (64) adapted for engagement on a bottle neck, the lower ends (48) configured to surround said screw (16) in said operable position, the screw having, at a lower end, a tip (78) adapted for entering a cork to be pulled between said lower ends (48) of the prongs (40), the improvement wherein:

said upper prong ends (42) are articulated to a core unit (20) within the cap (18);

said upper prong ends (42) of said prongs (40) being spring-biased to provide a force spreading prongs (40) towards a perimeter of the cap (18) so as to enable the lower ends (48) of said prongs (40) to fit easily over bottle necks of various sizes, the cap (18) includes a lower peripheral edge (60) serving as a stop to an outer portion (62) of each of said upper prong ends (42), and the screw stem (14) is guided in a guide bush (22) that is integral with the core unit (20).

2. A corkscrew according to claim 1, wherein said handle (12) is integral with said cap (18), said cap (18) dimensioned for surrounding said guide bush (22).

3. A corkscrew according to claim 2, wherein on either side of said guide bush (22), the core unit (20) comprises cheeks (30) for receiving respective inner ends (57) of respective compression springs (56) having opposite outer ends (58) seated in blind holes (54) of respectively associated ones of said upper prong ends (42).

4. A corkscrew according to claim 3, wherein said cheeks (30) are parallel to each other and each cheek has a transverse bore (32);

wherein each of said upper prong ends (42) includes a lug (50) having a transverse bore (52) which matches a transverse bore (32) in a corresponding parallel cheek (30), and wherein pins (34) extend through the matching bores (32, 52) for support of each lug (50).

5. A corkscrew according to claim 4, wherein said cheeks are arranged as two pairs of parallel cheeks (30), each pair of parallel cheeks defining a chamber (36) for receiving a lug (50), and wherein each blind hole (54) is radially arranged in the lug (50) below its associated transverse bore (52).

6. A corkscrew according to claim 1, wherein said core unit (20) comprises two parallel bearing means (30, 32, 34) at a socket (26) for articulating said upper prong ends (42), said bearing means disposed adjacent a flange (24) of said core unit (20) and transverse to an axis (A) thereof.

7. A corkscrew according to claim 1, wherein the prongs (40) each have a central portion (46) comprising a radial rib (44) that extends radially from an inner prong wall (47) and has a lower leading edge (45) that is curved or tapered relative to a corkscrew axis (A).

8. A corkscrew according to claim 1, wherein each prong (40) comprises an inner groove (66) having a detent (68) therein for retaining one of said shoulder stops (64), the shoulder stops having a semi-circular shape.

9. A corkscrew according to claim 1, wherein the stem portion (14) is exchangeably mounted to said handle (12).

10. A corkscrew according to claim 9, wherein said stem portion (14) comprises an upper square portion (74) adapted to be inserted into a square hole (72) of said handle (12) and to be bolted thereto.

11. A corkscrew according to claim 1, further comprising a sliding ring (38) for snugly encompassing a socket (26) of said core unit (20) and a sliding sleeve (80) for snugly fitting the guide bush (22) inside a handle collet (82).

12. A corkscrew according to claim 11, wherein said sliding ring (38) including a lower peripheral edge (60) serving as a stop to an outer portion (62) of each of said upper prong ends (42).

13. A corkscrew according to claim 1, wherein said screw (16') has a lower end adjacent a tip (78) thereof, said lower end of said screw (16') having a larger outer diameter (D) than all other screw portions of the screw, and wherein an inner diameter (d) of a bore (81) of a sleeve (80) positioned over a top of the screw (16') is smaller than the outer diameter (D) of said lower end of said screw, whereby the lower end of said screw is adapted to engage said sleeve (80).

14. A corkscrew according to claim 1, wherein said screw (16') is of a bladed type and comprises coil flares shaped to provide a continuous sharp helical edge ending in a point tip (78).

15. A corkscrew according to claim 1, wherein said screw (16") is of a hollow type and comprises a round wire helix ending in a pointed tip (78).

16. A corkscrew according to claim 1, wherein said screw (16, 16', 16") is made of steel and is surface-treated for minimum friction by one of plating, enameling and teflon-coating.

17. In a corkscrew (10) including a handle (12), the handle being mounted to an upper stem portion (14) of a screw (16), the stem portion (14) rotatably extending through a cap (18'), the cap containing upper prong ends (42) of two prongs (40), the prongs (40) having semi-circular lower ends (48), said lower ends (48) having shoulder stops (64) adapted for engagement on a bottle neck, the lower ends (48) configured to surround said screw (16), the screw having at a lower end, a tip (78) adapted for entering a cork to be pulled between said lower ends (48) of the prongs (40), the improvement wherein:

said upper prong ends (42) are articulated to a core unit (20') within the cap (18');

said upper prong ends (42) of said prongs (40) being spring-biased to provide a force spreading prongs (40) towards a perimeter of the cap (18') so as to enable the lower ends (48) of said prongs (40) to fit easily over bottle necks of various sizes, the cap (18') includes a lower peripheral edge (60) serving as a stop to an outer portion (62) of each of said upper prong ends (42), and the screw stem (14) is guided in a guide bush (22') that is integral with said cap (18').

18. A corkscrew according to claim 17, wherein said stem portion (14) comprises a threaded stem extension (84), said handle (12) includes a threaded hole (88) for threadedly engaging with said threaded stem extension (84) extending through said guide bush (22').

19. A corkscrew according to claim 18, wherein said screw (16) comprises a bolt portion (90) for detachably screwing to a threaded hole (92) of stem (84) and a stop ring (85) interposed between said screw and said stem.

20. A corkscrew according to claim 17, further comprising a snap ring (70) received in said lower ends (48) of said prongs to provide a contracting force that equals or exceeds the spreading force of a pair of prong springs (56).

21. A corkscrew according to claim 17, wherein the prongs (40) each have a central portion (46) comprising a radial rib (44) that extends radially from an inner prong wall (47) and has a lower leading edge (45) that is curved or tapered relative to a corkscrew axis (A).

22. A corkscrew according to claim 17, wherein each prong (40) comprises an inner groove (66) having a detent (68) therein for retaining one of said shoulder stops (64), the shoulder stops having a semi-circular shape.

23. A corkscrew according to claim 17, wherein the stem portion (14) is exchangeably mounted to said handle (12).

* * * * *